US009821368B2

(12) United States Patent
Eibl

(10) Patent No.: US 9,821,368 B2
(45) Date of Patent: Nov. 21, 2017

(54) METHOD FOR PRODUCING A CYLINDRICAL COMPONENT

(71) Applicant: MTU Aero Engines AG, Munich (DE)

(72) Inventor: Helmut Eibl, Furstenfeldbruck (DE)

(73) Assignee: MTU AERO ENGINES AG, Munich (DE)

( * ) Notice: Subject to any disclaimer, the term of this patent is extended or adjusted under 35 U.S.C. 154(b) by 501 days.

(21) Appl. No.: 14/563,300

(22) Filed: Dec. 8, 2014

(65) Prior Publication Data

US 2015/0165516 A1 Jun. 18, 2015

(30) Foreign Application Priority Data

Dec. 16, 2013 (DE) ..... 10 2013 225 987

(51) Int. Cl.

| | |
|---|---|
| ***B21K 1/26*** | (2006.01) |
| ***B21J 5/06*** | (2006.01) |
| ***F01D 25/24*** | (2006.01) |
| ***B21D 22/26*** | (2006.01) |
| *B21D 5/01* | (2006.01) |

(52) U.S. Cl.

CPC ..... *B21K 1/26* (2013.01); *B21D 22/26* (2013.01); *B21J 5/06* (2013.01); *F01D 25/24* (2013.01); *B21D 5/01* (2013.01); *Y10T 29/4932* (2015.01)

(58) Field of Classification Search

CPC ..... B21D 22/26; F01D 25/24; B21J 5/06; B21K 1/26

See application file for complete search history.

(56) References Cited

U.S. PATENT DOCUMENTS

| | | | | |
|---|---|---|---|---|
| 3,992,764 | A * | 11/1976 | Serasio | B21D 53/12 29/898.067 |
| 4,083,221 | A * | 4/1978 | Whitted | B21D 5/01 72/339 |
| 2004/0082432 | A1* | 4/2004 | Suzumura | F16H 57/082 475/331 |
| 2004/0250404 | A1* | 12/2004 | Cripsey | B21C 37/0815 29/460 |

FOREIGN PATENT DOCUMENTS

| | | |
|---|---|---|
| DE | 26 41 918 A1 | 3/1977 |
| DE | 44 38 657 A1 | 5/1995 |
| DE | 10 2010 005 059 A1 | 7/2011 |
| DE | 10 2011 004 192 A1 | 8/2012 |

* cited by examiner

*Primary Examiner* — Moshe Wilensky
(74) *Attorney, Agent, or Firm* — Barlow, Josephs & Holmes, Ltd.

(57) ABSTRACT

The invention relates to a method for producing a cylindrical component, particularly of turbomachines. In the process, a heated blank is provided. The blank is then formed to create a flat blank (2). The flat blank (2) is next bent and/or rolled to form a cylindrical half-shell (40).

11 Claims, 1 Drawing Sheet

METHOD FOR PRODUCING A CYLINDRICAL COMPONENT

BACKGROUND OF THE INVENTION

The invention relates to a method for producing a cylindrical component in accordance with the present invention.

Blanks for cylindrical housings, such as, for example, engine housings, are typically ring-rolled. In this process, the heated torus-shaped blank is rolled between a cylindrical mandrel roller arranged inside of the blank and a cylindrical main roller arranged outside of the blank, with the axes of the mandrel roller and the main roller lying parallel to the axis of the workpiece being formed. Simultaneously, two conical axial rollers are arranged above and below the blank on the side diametrically opposite to the blank. The mandrel roller and the main roller determine the radial thickness of the blank (also referred to as the wall thickness of the blank) and the two axial rollers determine the axial length of the blank. For reasons of strength, the housing has ribs, so that the wall thickness of the blank has to be at least as great as the rib height. In particular, cylindrical housings typically do not have a uniform thickness. The ribs are created in the cylindrical outer wall of the blank by machining, such as, for example, by milling, after ring rolling. This process is particularly detrimental, because a very large volume of material debris is produced. Furthermore, in the case of longitudinally divided housings, the ring has to be cut open to form a half-shell, so that an additional operating step ensues in order to be able to produce the final product.

Furthermore, housings of turbomachines particularly have to satisfy the so-called containment criterion. This means that rotating components located in the housing must not penetrate through the housing in the event of a defect, such as, for example, the fracture of a rotor blade. If the housings are cast, the containment criterion can be met only by using an appropriately large mass. This entails the drawback that the housings are heavier than housings produced by machining.

SUMMARY OF THE INVENTION

Accordingly, the present invention is based on the object of proposing a method in which less volume of material debris is created during the production of cylindrical components and which is more economical in production.

The object is achieved by the method of the present invention.

The invention relates to a method for producing a cylindrical component, particularly one of turbomachines. First of all, a heated blank is provided. The blank is then press-formed to create a flat blank. The flat blank is next bent and/or rolled to form a cylindrical half-shell. In the process, the blank may be heated to a temperature above the recrystallization temperature of the blank material. This offers the advantage that, in comparison to ring rolling, cutting to create a half-shell is dispensed with.

In an advantageous embodiment of the invention, the flat blank is essentially rectangular in shape. This offers the advantage that little protruding material is created by press forming and the flat blank exhibits a form similar to that of the later final product.

In another advantageous embodiment of the invention, the flat blank has a machining allowance on at least one of its contours. This offers the advantage that, during press forming, any lacking dimensional accuracy can thereby be compensated for. In this case, the machining allowance can be between 0 and 10 mm. In particular, the machining allowance may only be necessary on the contours that later constitute a contact surface.

In another advantageous embodiment of the invention, at least one rib and/or one eyelet is formed in at least one of the surfaces of the blank. In this case, these raised areas (ribs, eyelets, or upset eyelets) are formed at the same time as the press-forming operation. This offers the advantage that these raised areas do not need to be machined out of the solid material. In comparison to ring rolling, little or no material debris volume is created. In this case, the raised areas may be produced advantageously in the surface of the blank without any machining allowance, so that the ribs, the eyelets, and the upset eyelets do not need to be post-finished.

In another advantageous embodiment of the invention, at least one contact surface of the half-shell is machined, in particular milled, to a final dimension. This is especially advantageous, because, as a result, it is possible to achieve greater dimensional accuracy than is possible at all by press forming. Any final machining is then necessary only at the required places, such as, for example, the contact surfaces, so that the volume of material debris is minimized.

In another advantageous embodiment of the invention, the press forming is accomplished by drop forging. In this method, the form of the forged piece (blank) is reproduced as a negative in the top and bottom forging dies. Preferably, closed forging dies are used. This offers the advantage that the blank material is handled in a very material-saving manner, because the volume of the blank is only somewhat greater than that of the finished half-shell.

In another advantageous embodiment of the invention, a housing comprises two half-shells. These half-shells exhibit identical outer contours after press forming. This offers the advantage that the top half-shell of a housing can be produced by using the same forging dies as those used for the bottom half-shell of the housing, so that only one set of forging dies is needed. This saves tool costs. The various half-shells can have different eyelets for the attachment of holders. These differences are machined into the corresponding half-shells only after press forming is complete.

Additional advantageous embodiments of the invention are set forth in detail below.

BRIEF DESCRIPTION OF THE DRAWING FIGURES

In the following, preferred exemplary embodiments of the invention will be described in detail on the basis of the schematic drawing. Shown therein are:

DESCRIPTION OF THE INVENTION

Figure 1:
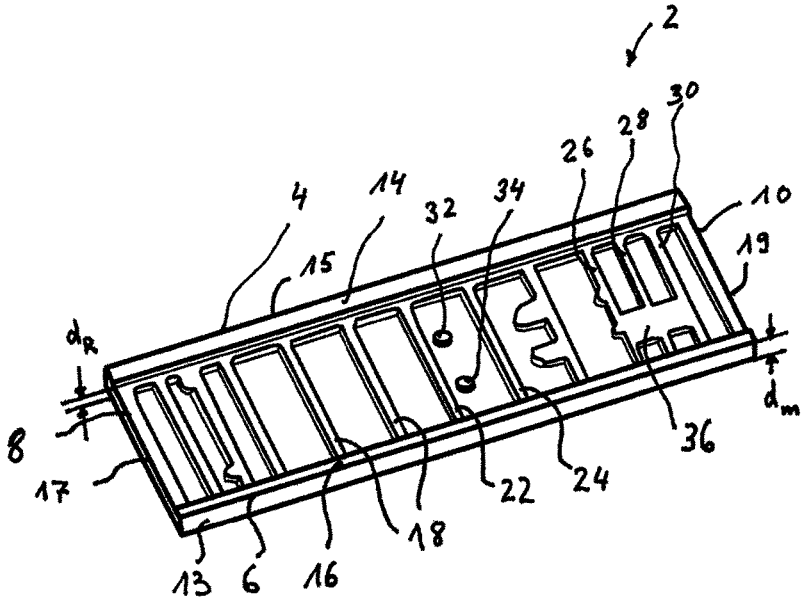
FIG. 1 is a plan view of a blank according to the invention.

Shown in FIG. 1 is a plan view of an essentially rectangularly shaped blank 2 according to the invention. Preferably, the flat blank 2 is drop-forged beforehand using a closed forging die. The blank 2 has a top lengthwise edge 4 and a bottom lengthwise edge 6, which are joined at their ends via a first cross edge 8 depicted on the left in FIG. 1 and a second cross edge 10 depicted on the right in FIG. 1. The outer face 12 can be seen between the edges 4 to 10. A first flange projection 14 is formed on the outer face 12 along the top lengthwise edge 4 and has the maximum thickness $d_m$ of the blank 2. Furthermore, a second flange projection 16 is formed on the outer face 12 along the bottom lengthwise edge 6 and likewise can have the maximum thickness $d_m$ of the blank 2. The blank 2 is designed to be somewhat thinner between the two flange projections 14 and 16 and exhibits a thickness $d_R$ that is less than the maximum thickness $d_m$.

The front first contact surface 13 borders the bottom lengthwise edge 6 on the outer face 12. The rear second contact surface 15, which is not depicted, borders the top lengthwise edge 4 on the outer face 12. The third contact surface 17 borders the first cross edge 8 on the outer face 12. The fourth contact surface 19, which is not depicted, borders the second cross edge 10 on the outer face 12.

A plurality of cross ribs 18 to 30 lie between the flange projections 14 and 16 and, in this case, are parallel to the cross edges 8 and 10. The position of the ribs is typically defined by the strength requirements. In this case, all cross ribs 18 to 30 have the same thickness $d_R$. Molded between the cross ribs 22 and 24 are two upset eyelets 32 and 34, which can be bored out in a latter processing step. It is also conceivable that, instead of the upset eyelets 32 and 34, eyelets can be produced directly by press forming. This would save a later machining step (for example, boring) that produces material debris.

The cross ribs 26 to 30 can be joined to one another via a lengthwise rib 36, if this is required for reasons of structural mechanics, for example.

The outer face 12, together with all corresponding contours, such as ribs and/or upset eyelets or eyelets, may be produced advantageously without any machining allowance during drop forging, so that any later machining of this outer face 12 is dispensed with.

Figure 2:
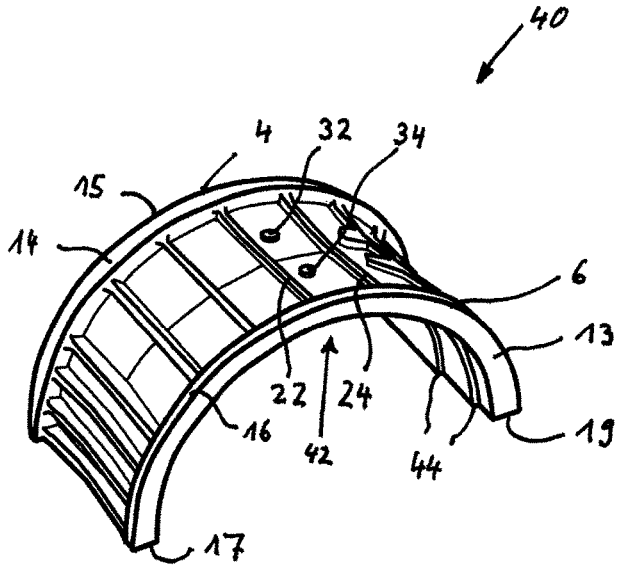
FIG. 2 is an oblique view of a half-shell according to the invention.

The blank 2 is than bent or rolled, so that the essentially cylindrical half-shell 40 depicted in FIG. 2 is created. In this process, particularly the lengthwise edges 4 and 6 are bent, so that the first and second contact surfaces 13 and 15 describe a semicircle, with the outer face 12 constituting the jacket surface of the half-cylinder. Once bending is complete, the individual contact surfaces 13, 15, 17, and 19 may be additionally finished, preferably by machining them, so as to obtain the required dimensional accuracy. Thus, a particularly high planarity of the contact surfaces 17 and 19 is required if two such half-shells are to be assembled to form a housing. As a result, it is then ensured that the required tightness is achieved between two half-shells 40 at the contact surfaces 17 and 19. Various indentations 44 may be present on the inner face 42 of the half-shell 40.

What is claimed is:

1. A method for producing a cylindrical component for turbomachines, comprising the steps of:

(a) providing a heated blank;

(b) press forming the heated blank to form a flat blank;

(c) bending or rolling the flat blank into a cylindrical half-shell;

(d) forming at least two half-cylindrical-shells with steps (a) through (c); and (e) configuring and arranging the at least two half-cylindrical-shells formed in step (d) into a housing.

2. The method according to claim 1, wherein the flat blank is substantially rectangular in shape.

3. The method according to claim 1, wherein the flat blank has a machining allowance on at least one of its contours.

4. The method according to claim 3, wherein the machining allowance is between 0 and 10 mm.

5. The method according to claim 1, wherein at least one rib and/or one eyelet is formed in at least one surface of the blank.

6. The method according to claim 1, wherein at least one contact surface of each of the half-cylindrical-shells is machined to a final dimension.

7. The method according to claim 1, wherein the step of press forming is accomplished by drop forging.

8. The method according to claim 1, wherein the at least two half-cylindrical-shells have identical outer contours after the step of press forming is complete.

9. The method according to claim 8, further comprising the step of:

(f) providing the housing as a cylindrical component in a turbomachine.

10. The method according to claim 8, further comprising the step of:

providing the housing as a cylindrical component in a turbomachine.

11. A method for producing a cylindrical component for turbomachines, comprising the steps of:

providing a heated blank;

press forming the heated blank to form a flat blank;

bending or rolling the flat blank into a half-cylindrical-shell;

forming at least two half-cylindrcal-shells; and configuring and arranging the at least two half-cylindrical-shells into a housing, the at least two cylindrical half-shells having identical outer contours after the step of press forming is complete.

* * * * *